US005829271A

United States Patent [19]

Lynch et al.

[11] Patent Number: 5,829,271

[45] Date of Patent: Nov. 3, 1998

[54] CRYOGENIC RECTIFICATION SYSTEM FOR PRODUCING HIGH PRESSURE OXYGEN

[75] Inventors: Nancy Jean Lynch, North Tonawanda; Dante Patrick Bonaquist, Grand Island; Shanda Gardner Fry, Tonawanda, all of N.Y.

[73] Assignee: Praxair Technology, Inc., Danbury, Conn.

[21] Appl. No.: 949,455

[22] Filed: Oct. 14, 1997

[51] Int. Cl.[6] ..... F25J 3/00

[52] U.S. Cl. ..... 62/646; 62/652

[58] Field of Search ..... 62/646, 652

[56] References Cited

U.S. PATENT DOCUMENTS

| | | | |
|---|---|---|---|
| 4,017,284 | 4/1977 | Gifford | 62/40 |
| 5,233,838 | 8/1993 | Howard | 62/25 |
| 5,235,816 | 8/1993 | Parsnick et al. | 62/22 |
| 5,365,741 | 11/1994 | Roberts et al. | 62/38 |
| 5,386,692 | 2/1995 | Laforce | 62/25 |
| 5,396,773 | 3/1995 | Ha et al. | 62/646 |
| 5,431,023 | 7/1995 | Howard et al. | 62/37 |
| 5,454,227 | 10/1995 | Straub et al. | 62/25 |
| 5,467,602 | 11/1995 | Paolino et al. | 62/38 |
| 5,564,290 | 10/1996 | Bonaquist et al. | 62/646 |

*Primary Examiner*—Ronald Capossela
*Attorney, Agent, or Firm*—Stanley Ktorides

[57] ABSTRACT

A cryogenic rectification system for producing high pressure oxygen wherein a portion of the feed air is condensed by indirect heat exchange with pressurized liquid oxygen and then passed, preferably after subcooling, into the lower pressure column of a double column system.

10 Claims, 2 Drawing Sheets

CRYOGENIC RECTIFICATION SYSTEM FOR PRODUCING HIGH PRESSURE OXYGEN

TECHNICAL FIELD

This invention relates generally to the cryogenic rectification of feed air using a double column system to produce oxygen and, more particularly, to such a system when neither nitrogen nor argon is produced from the lower pressure column of the double column.

BACKGROUND ART

Oxygen is produced commercially in large quantities by the cryogenic rectification of feed air, generally employing the well known double column system, wherein product oxygen is taken from the lower pressure column. At times it may be desirable to produce oxygen at a pressure which exceeds its pressure when taken from the lower pressure column. In such instances, gaseous oxygen may be compressed to the desired pressure. However, it is generally preferable for capital cost purposes to remove oxygen as liquid from the lower pressure column, increase its pressure, and then vaporize the pressurized liquid oxygen to produce the desired high pressure product oxygen gas.

Typically, in such a double column system, product nitrogen is also produced in, and recovered from, the lower pressure column. Furthermore, often a stream is passed from the lower pressure column into an argon sidearm column wherein argon is produced. However, sometimes the only product desired directly or indirectly from the lower pressure column is oxygen and, in such a situation, it is imperative that the system operate as efficiently as possible, since neither nitrogen nor argon taken from the lower pressure column may be used as product to offset the capital and operating costs of the system. This is particularly the case when the product oxygen is desired at a high pressure as this adds further costs to the system.

Accordingly, it is an object of this invention to provide an improved double column cryogenic rectification system for producing high pressure oxygen wherein no other product is recovered directly or indirectly from the lower pressure column.

SUMMARY OF THE INVENTION

The above and other objects, which will become apparent to those skilled in the art upon a reading of this disclosure, are attained by the present invention, one aspect of which is:

A method for producing high pressure oxygen comprising:

(A) passing a first portion of feed air into a higher pressure column and passing fluid from the higher pressure column into a lower pressure column;

(B) condensing a second portion of feed air and passing resulting liquid feed air into the lower pressure column;

(C) producing liquid oxygen by cryogenic rectification within the lower pressure column;

(D) increasing the pressure of the liquid oxygen to produce high pressure liquid oxygen, and vaporizing the high pressure liquid oxygen by indirect heat exchange with the condensing feed air second portion to produce high pressure oxygen gas; and (E) recovering high pressure oxygen gas.

Another aspect of the invention is:

Apparatus for producing high pressure oxygen comprising:

(A) a first column, a second column, and means for passing feed air into the first column;

(B) a product boiler, means for passing feed air to the product boiler, and means for passing feed air from the product boiler into the second column;

(C) means for passing fluid from the first column into the second column;

(D) means for withdrawing fluid from the lower portion of the second column, increasing the pressure of the withdrawn fluid, and passing the withdrawn fluid to the product boiler; and (E) means for recovering product high pressure oxygen from the product boiler.

As used herein the term "liquid oxygen" means a liquid having an oxygen concentration of at least 98 mole percent.

As used herein, the term "feed air" means a mixture comprising primarily nitrogen, argon and oxygen, such as ambient air.

As used herein, the term "product boiler" means a heat exchanger wherein liquid oxygen is vaporized and feed air is condensed. The product boiler may be a separate heat exchanger or may be a portion of the primary heat exchanger of the cryogenic air separation plant.

As used herein the terms "subcooling" and "subcooler" mean respectively method and apparatus for cooling a liquid to be at a temperature lower than the saturation temperature of that liquid for the existing pressure.

As used herein, the terms "turboexpansion" and "turboexpander" mean respectively method and apparatus for the flow of high pressure gas through a turbine to reduce the pressure and the temperature of the gas.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements which may be structured packing and/or random packing elements. For a further discussion of distillation columns see the Chemical Engineers' Handbook fifth edition, edited by R. J. Perry and C. H. Chilton, McGraw-Hill Book Company, New York, Section 13, The Continuous Distillation Process. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin (K).

As used herein, the term "indirect heat exchange" means the bringing of two fluids into heat exchange relation without any physical contact or intermixing of the fluids with each other.

As used herein, the terms "upper portion" and "lower portion" of a column mean those portions respectively above and below the midpoint of the column.

As used herein, the term "top" of a column means that section of the column above the internals, e.g. trays or packing, of the column.

DETAILED DESCRIPTION

The invention will be described in detail with reference to the Drawings.

Figure 1:
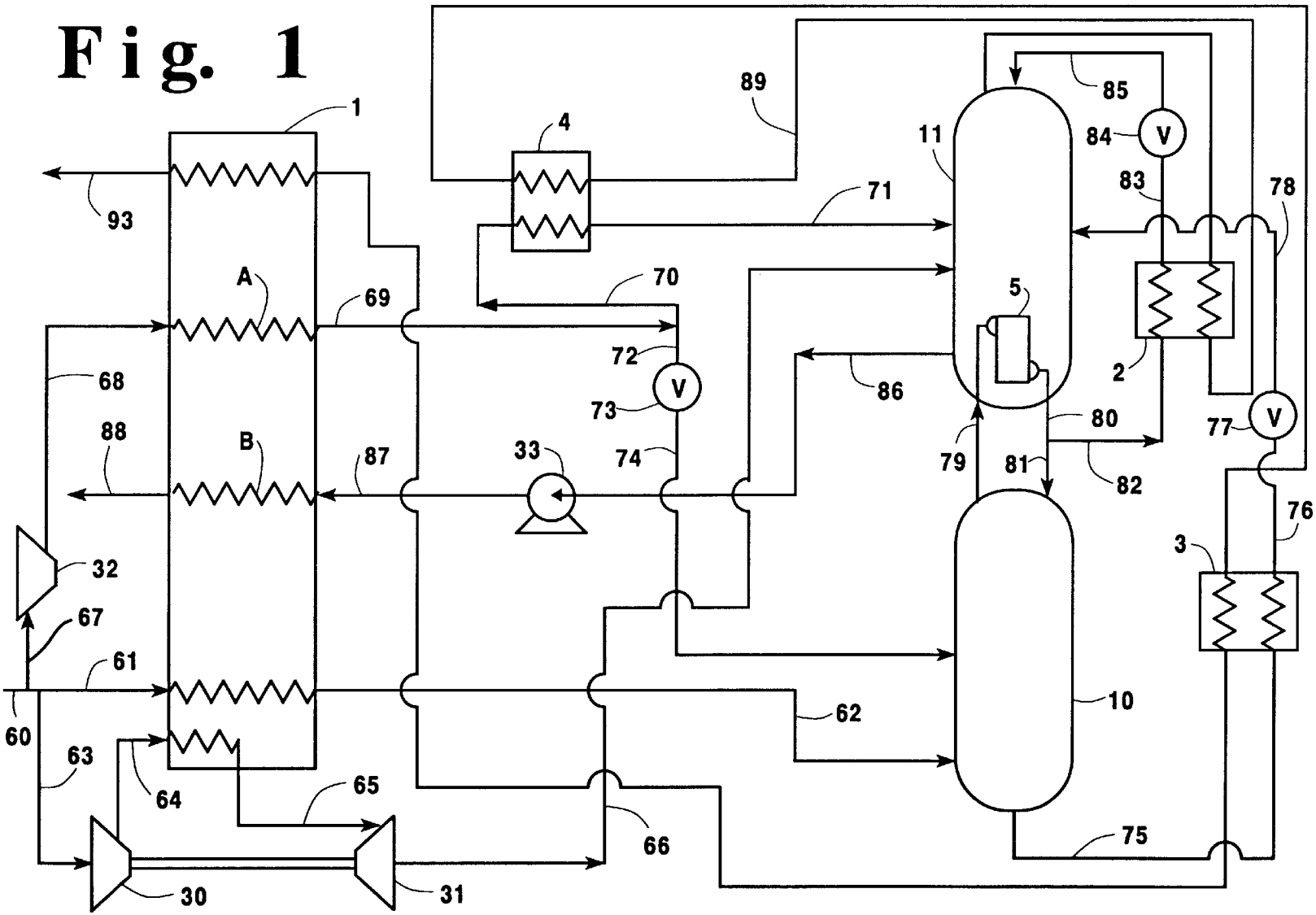
FIG. 1 is a schematic representation of one preferred embodiment of the cryogenic rectification system of the invention.

Referring now to FIG. 1, feed air 60 which has been cleaned of high boiling impurities such as water vapor, carbon dioxide and hydrocarbons, and is at a pressure generally within the range of from 70 to 100 pounds per square inch absolute (psia), is divided into first portion 61, second portion 67 and third portion 63. First portion 61, comprising from about 60 to 76 percent of feed air 60, is cooled by passage through primary heat exchanger 1 and resulting cooled feed air first portion 62 is passed into first or higher pressure column 10.

Second feed air portion 67, comprising from about 20 to 30 percent of feed air 60, is further compressed by passage through compressor 32 to a pressure within the range of from 120 to 500 psia. Resulting high pressure second feed air portion 68 is condensed by indirect heat exchange with liquid oxygen, as will be further discussed below, in the product boiler section of primary heat exchanger 1. In the embodiment of the invention illustrated in FIG. 1 the product boiler is the section of primary heat exchanger 1 comprising heat exchange passages A and B.

Resulting liquid feed air 69 from the product boiler is passed into second or lower pressure column 11 at an intermediate level of the column, i.e. below the top of column 11. In the embodiment illustrated in FIG. 1, liquid feed air 69 is divided into first part 70 and second part 72. First part 70, comprising from at least 40 percent of liquid feed air 69, and may be up to 100 percent of liquid feed air 69, is subcooled by passage through subcooler 4 and then passed, as aforedescribed, into lower pressure column 11 as stream 71. Second part 72, comprising the remainder, if any, of liquid feed air stream 69, is passed through valve 73 and, as stream 74, into higher pressure column 10.

The embodiment of the invention illustrated in FIG. 1 wherein the liquid feed air passed into the lower pressure column is subcooled prior to its introduction into the lower pressure column, is a particularly preferred embodiment in that oxygen recovery is maximized.

In conventional practice if feed air is liquefied the liquefied feed air is passed entirely into the higher pressure column. Since very little argon-oxygen separation occurs in the higher pressure column, most of the argon in the feed air is passed into the lower pressure column with the oxygen-enriched bottom liquid from the higher pressure column. This, combined with the greater flow of this kettle liquid to the lower pressure column, concentrates the argon in the lower pressure column below the kettle liquid feed point, which is advantageous for argon recovery, as well as for nitrogen recovery from the upper portion of the lower pressure column.

In the practice of this invention with liquefied air passed into the lower pressure column, argon-oxygen separation does occur in the higher pressure column enabling vapor leaving the top of the lower pressure column to have a higher argon concentration while maintaining a low oxygen concentration. Moreover, the liquefied air serves as an intermediate reflux to the lower pressure column, increasing the liquid to vapor ratio (L/V) in that section of the column thus aiding the separation. The introduction of the liquefied air into the lower pressure column also serves to reduce the feed rate of the kettle liquid from the higher pressure column into the lower pressure column, enabling argon to move upward within the lower pressure column.

When a stream enters a column above column temperature, some liquid is vaporized to absorb the heat introduced by the higher temperature stream. Thus for a given flow rate, warmer feed delivers less liquid reflux to the column than colder feed does. Subcooling the feed air to the lower pressure column helps to increase the oxygen recovery by effectively providing more reflux to the column. Subcooling feed air and then feeding it to the higher pressure column would provide no benefit. In the practice of this invention the lower pressure column contains 5–20 more equilibrium stages between the top of the column and the liquid air feed point than is found in a conventional lower pressure column. This section of the column performs the task of separating nitrogen and argon as the more volatile components from oxygen.

In the preferred embodiment of the invention illustrated in FIG. 1 a third feed air portion is employed. Referring back now to FIG. 1, third feed air portion 63, comprising from about 4 to 10 percent of feed air 60, is further compressed to a pressure within the range of from 95 to 160 psia in compressor 30. Resulting further compressed feed air third portion 64 is cooled by partial traverse of primary heat exchanger 1 and, as stream 65, turboexpanded by passage through turboexpander 31. Resulting turboexpanded third feed air portion 66 is passed from turboexpander 31 into lower pressure column 11. Preferably, as illustrated in FIG. 1, compressor 30 and turboexpander 31 are directly coupled so that the operation of turboexpander 31 serves to drive compressor 30.

First or higher pressure column 10 is operating at a pressure generally within the range of from 70 to 90 psia. Within higher pressure column 10 the feed air is separated by cryogenic rectification into nitrogen-enriched vapor and oxygen-enriched liquid. Nitrogen-enriched vapor is withdrawn from the upper portion of higher pressure column 10 in stream 79 and passed into bottom reboiler 5 wherein it is condensed by indirect heat exchange with boiling lower pressure column 11 bottom liquid. Resulting nitrogen-enriched liquid 80 is divided into a first part 81 which is passed into the upper portion of higher pressure column 10 as reflux, and into second part 82 which is subcooled by passage through subcooler 2. Subcooled nitrogen-enriched liquid stream 83 is passed through valve 84 and then as stream 85 into the upper portion of lower pressure column 11 as reflux. Oxygen-enriched liquid is withdrawn from the lower portion of higher pressure column 10 in stream 75 and subcooled by passage through subcooler 3. Resulting subcooled oxygen-enriched liquid stream 76 is passed through valve 77 and as stream 78 into lower pressure column 11.

Second or lower pressure column 11 is operating at a pressure less than that of higher pressure column 10 and generally within the range of from 18 to 25 psia. Within lower pressure column 11 the various feeds into the column are separated by cryogenic rectification into liquid oxygen and waste vapor. Waste vapor is withdrawn from the top of lower pressure column 11 in stream 89, which is warmed by passage through subcoolers 2, 3 and 4 and primary heat exchanger 1 and removed from the system in stream 93 which is released to the atmosphere.

Liquid oxygen is withdrawn from the lower portion of lower pressure column 11 in stream 86. This is the only fluid from lower pressure column 11 which is recovered as product. If desired, a portion of stream 86 may be recovered a product liquid oxygen. In the embodiment illustrated in FIG. 1 all of stream 86 is increased in pressure, such as by operation of liquid head or, as illustrated in FIG. 1, by operation of liquid pump 33. High pressure liquid oxygen 87 is vaporized by passage through the product boiler portion of primary heat exchanger 1 by indirect heat exchange with the aforesaid condensing second portion of the feed air and recovered as product high pressure oxygen gas 88 having an oxygen concentration of at least 98 mole percent and at a pressure within the range of from 40 to 250 psia.

Figure 2:
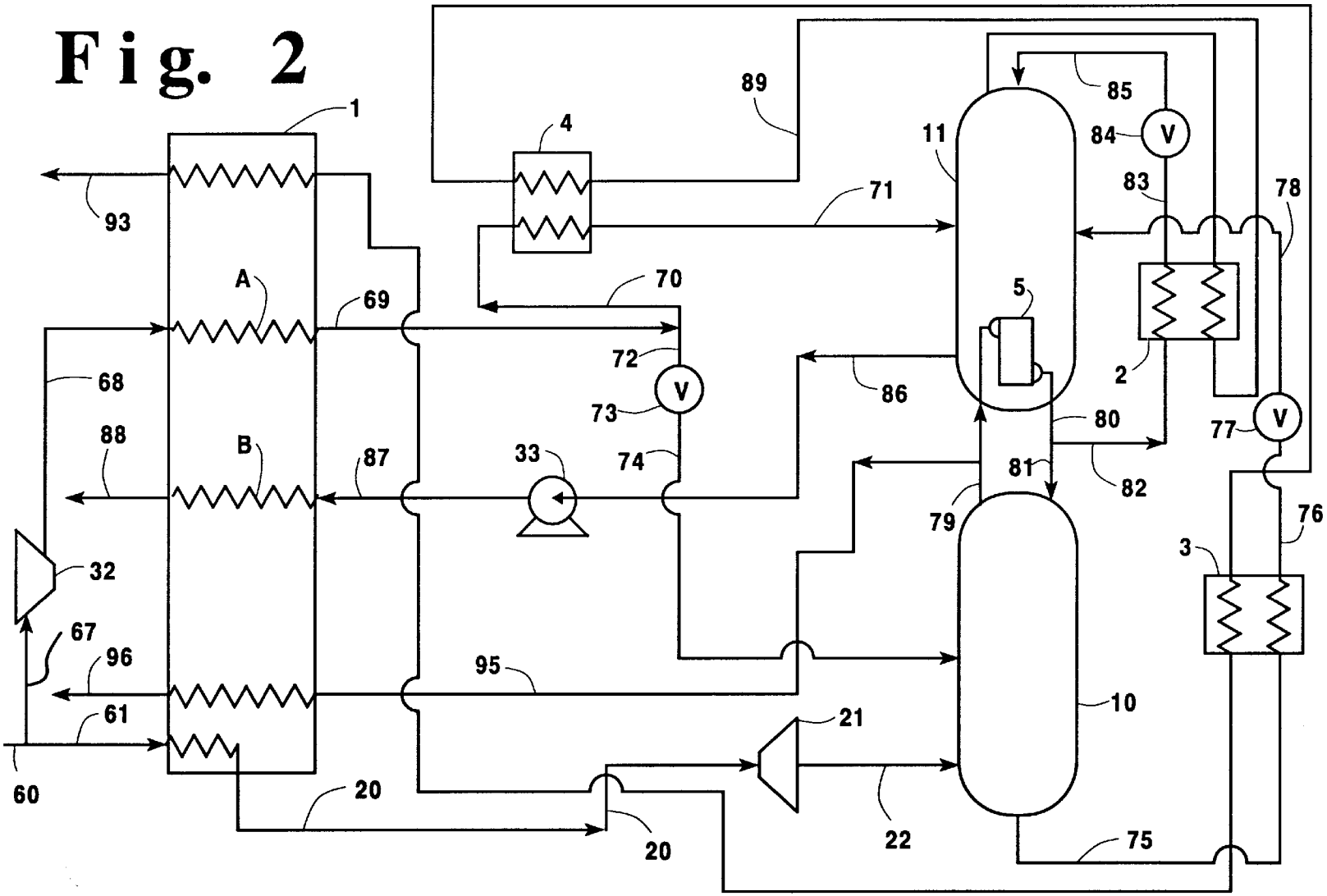
FIG. 2 is a schematic representation of another preferred embodiment of the cryogenic rectification system of the invention.

FIG. 2 illustrates another preferred embodiment of the invention wherein high pressure nitrogen gas is additionally recovered. The numerals in FIG. 2 correspond to those of FIG. 1 for the common elements, and these common elements will not be discussed again in detail.

Referring now to FIG. 2, first feed air portion 61 partially traverses primary heat exchanger 1. Resulting cooled feed air stream 20 is turboexpanded by passage through turboexpander 21 and resulting turboexpanded feed air first portion 22 is passed into higher pressure column 10. A portion 95 of nitrogen-enriched vapor 79 is warmed by passage through primary heat exchanger 1 and recovered as high pressure nitrogen gas 96 having a nitrogen concentration of at least 99 mole percent and at a pressure within the range of from 68 to 88 psia.

Now by the use of this invention one can more efficiently produce high purity high pressure oxygen using a double column cryogenic air separation plant. Although the invention has been discussed in detail with a reference to certain preferred embodiments, those skilled in the art will recognize that there are other embodiments of the invention within the spirit and the scope of the claims.

We claim:

1. A method for producing high pressure oxygen comprising:

(A) passing a first portion of feed air into a higher pressure column and passing fluid from the higher pressure column into a lower pressure column;

(B) condensing a second portion of feed air and passing resulting liquid feed air into the lower pressure column;

(C) producing liquid oxygen by cryogenic rectification within the lower pressure column;

(D) increasing the pressure of the liquid oxygen to produce high pressure liquid oxygen, and vaporizing the high pressure liquid oxygen by indirect heat exchange with the condensing feed air second portion to produce high pressure oxygen gas; and (E) recovering high pressure oxygen gas.

2. The method of claim 1 wherein the liquid feed air is subcooled prior to passage into the lower pressure column.

3. The method of claim 1 wherein a portion of the liquid feed air is passed into the higher pressure column.

4. The method of claim 1 wherein the first portion of the feed air is turboexpanded prior to passage into the higher pressure column.

5. The method of claim 1 further comprising turboexpanding a third portion of the feed air and passing the turboexpanded third portion into the lower pressure column.

6. Apparatus for producing high pressure oxygen comprising:

(A) a first column, a second column, and means for passing feed air into the first column;

(B) a product boiler, means for passing feed air to the product boiler, and means for passing feed air from the product boiler into the second column;

(C) means for passing fluid from the first column into the second column;

(D) means for withdrawing fluid from the lower portion of the second column, increasing the pressure of the withdrawn fluid, and passing the withdrawn fluid to the product boiler; and (E) means for recovering product high pressure oxygen from the product boiler.

7. The apparatus of claim 6 wherein the means for passing feed air from the product boiler into the second column includes a subcooler.

8. The apparatus of claim 6 further comprising means for passing feed air from the product boiler to the first column.

9. The apparatus of claim 6 wherein the means for passing feed air into the first column includes a turboexpander.

10. The apparatus of claim 6 further comprising means for recovering fluid from the upper portion of the first column.

* * * * *